US010162278B2

(12) United States Patent
Kuno et al.

(10) Patent No.: US 10,162,278 B2
(45) Date of Patent: Dec. 25, 2018

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Jumpei Kuno, Yokohama (JP); Kenichi Kaku, Suntou-gun (JP); Taichi Sato, Numazu (JP); Takashi Anezaki, Hiratsuka (JP); Atsushi Fujii, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/901,128

(22) Filed: Feb. 21, 2018

(65) Prior Publication Data

US 2018/0246426 A1 Aug. 30, 2018

(30) Foreign Application Priority Data

Feb. 28, 2017 (JP) ..... 2017-037024

(51) Int. Cl.
*G03G 5/14* (2006.01)

(52) U.S. Cl.
CPC ... *G03G 5/144* (2013.01); *G03G 2215/00962* (2013.01); *G03G 2221/183* (2013.01)

(58) Field of Classification Search
CPC ..... G03G 5/144
See application file for complete search history.

(56) References Cited

U.S. PATENT DOCUMENTS 5,955,250 A * 9/1999 Christian ..... B41M 5/426 430/528
6,773,856 B2 8/2004 Tanaka et al.
6,994,941 B2 2/2006 Tanaka et al.
7,045,261 B2 5/2006 Tanaka et al.
(Continued)

FOREIGN PATENT DOCUMENTS

EP 1011019 A1 6/2000
JP H04-294363 10/1992
(Continued)

OTHER PUBLICATIONS

English language machine translation of JP 2017-201045 (Nov. 2017).*
U.S. Appl. No. 15/895,148, Jumpei Kuno, filed Feb. 13, 2018.

*Primary Examiner* — Christopher D Rodee
(74) *Attorney, Agent, or Firm* — Venable LLP

(57) ABSTRACT

Disclosed herein is an electrophotographic photosensitive member in which leakage hardly occurs even in the case of using a layer containing metal oxide particles as an electrically conductive layer in the electrophotographic photosensitive member, and which is compatible with definition in output images, the electrophotographic photosensitive member sequentially including: a support, an electrically conductive layer, and a photosensitive layer, the electrically conductive layer containing a binder material and particles represented by General Formula (1).

$$Nb_{2.00}O_{5.00-X}N_Y \quad (1)$$

(In Formula (1), Nb is a niobium atom, O is an oxygen atom, N is a nitrogen atom, and $0.00<Y<X\leq 4.00$).

9 Claims, 4 Drawing Sheets

(56) References Cited

U.S. PATENT DOCUMENTS

| | | | |
|---|---|---|---|
| 7,245,851 | B2 | 7/2007 | Fujii et al. |
| 7,333,752 | B2 | 2/2008 | Kawahara et al. |
| 7,517,626 | B2 | 4/2009 | Tanaka et al. |
| 7,556,901 | B2 | 7/2009 | Anezaki et al. |
| 7,910,274 | B2 | 3/2011 | Tanaka et al. |
| 7,927,774 | B2 | 4/2011 | Ogaki et al. |
| 8,088,541 | B2 | 1/2012 | Tanaka et al. |
| 8,455,170 | B2 | 6/2013 | Nakamura et al. |
| 8,538,298 | B2 | 9/2013 | Harada et al. |
| 8,669,027 | B2 | 3/2014 | Anezaki et al. |
| 8,753,789 | B2 | 6/2014 | Ogaki et al. |
| 8,778,580 | B2 | 7/2014 | Tsuji et al. |
| 8,783,209 | B2 | 7/2014 | Kaku et al. |
| 8,921,020 | B2 | 12/2014 | Murai et al. |
| 8,980,508 | B2 | 3/2015 | Okuda et al. |
| 8,980,509 | B2 | 3/2015 | Noguchi et al. |
| 8,980,510 | B2 | 3/2015 | Fujii et al. |
| 9,029,054 | B2 | 5/2015 | Okuda et al. |
| 9,040,214 | B2 | 5/2015 | Fujii et al. |
| 9,046,797 | B2 | 6/2015 | Fujii et al. |
| 9,063,505 | B2 | 6/2015 | Sekiya et al. |
| 9,069,267 | B2 | 6/2015 | Kaku et al. |
| 9,075,333 | B2 | 7/2015 | Uematsu et al. |
| 9,098,006 | B2 | 8/2015 | Uematsu et al. |
| 9,158,213 | B2 | 10/2015 | Taniguchi et al. |
| 9,164,406 | B2 | 10/2015 | Nishi et al. |
| 9,188,888 | B2 | 11/2015 | Okuda et al. |
| 9,256,145 | B2 | 2/2016 | Fujii et al. |
| 9,256,153 | B2 | 2/2016 | Aoyama et al. |
| 9,274,442 | B2 | 3/2016 | Sato et al. |
| 9,372,417 | B2 | 6/2016 | Fujii et al. |
| 9,372,418 | B2 | 6/2016 | Shida et al. |
| 9,372,419 | B2 | 6/2016 | Tsuji et al. |
| 9,448,502 | B2 | 9/2016 | Taniguchi et al. |
| 9,523,929 | B2 | 12/2016 | Nakamura et al. |
| 9,563,139 | B2 | 2/2017 | Kawahara et al. |
| 9,599,914 | B2 | 3/2017 | Uematsu et al. |
| 9,599,915 | B2 | 3/2017 | Anezaki et al. |
| 9,599,917 | B2 | 3/2017 | Okuda et al. |
| 9,645,516 | B2 | 5/2017 | Kawahara et al. |
| 9,645,517 | B2 | 5/2017 | Sato et al. |
| 9,726,992 | B2 | 8/2017 | Sakuma et al. |
| 9,851,646 | B2 | 12/2017 | Tomono et al. |
| 2004/0259009 | A1* | 12/2004 | Itami ..... G03G 5/10 430/60 |
| 2012/0076539 | A1 | 3/2012 | Sato et al. |
| 2012/0121291 | A1 | 5/2012 | Tsuji et al. |
| 2014/0004450 | A1 | 1/2014 | Tokimitsu et al. |
| 2015/0346616 | A1 | 12/2015 | Kawahara et al. |
| 2015/0346617 | A1 | 12/2015 | Kawahara et al. |
| 2015/0362847 | A1 | 12/2015 | Tanaka et al. |
| 2018/0024460 | A1 | 1/2018 | Uematsu et al. |

FOREIGN PATENT DOCUMENTS

| | | |
|---|---|---|
| JP | H07-287475 | 10/1995 |
| JP | 2002-107984 | 4/2002 |
| JP | 2007-298568 | 11/2007 |
| JP | 2007-298569 | 11/2007 |
| JP | 2007-334334 | 12/2007 |
| JP | 2017201045 A * | 11/2017 |

* cited by examiner

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

Field of the Invention

The present invention relates to an electrophotographic photosensitive member, and a process cartridge and electrophotographic apparatus having the same.

Description of the Related Art

Recently, research and development for electrophotographic photosensitive members (organic electrophotographic photosensitive members) using an organic photoconductive material have been actively conducted.

The electrophotographic photosensitive member is basically composed of a support and a photosensitive layer formed on the support. However, actually, in order to conceal a surface defect of the support, protect the photosensitive layer from being electrically damaged, improve chargeability, and improve a charge injection inhibition ability from the support to the photosensitive layer, etc., various layers are frequently provided between the support and the photosensitive layer Among the layers provided between the support and the photosensitive layer, a layer containing metal oxide particles is known as a layer provided in order to conceal the surface defect of the support. Since the layer containing metal oxide particles generally has high conductivity as compared to a layer that does not contain metal oxide particles, at the time of image formation, an increase in residual potential is unlikely to occur, and a change in dark portion potential or light portion potential is unlikely to occur. An allowable range of the surface defect of the support is increased by providing the layer having high conductivity as described above (hereinafter, referred to as an 'electrically conductive layer') between the support and the photosensitive layer to conceal the surface defect of the support. As a result, since an allowable usable range of the support is significantly increased, there is an advantage in that productivity of the electrophotographic photosensitive member may be improved.

Further, recently, high definition of output images by electrophotography has been advanced. It is known that for high definition of output images, it is effective to reduce an irradiation spot diameter of image exposure light or reduce a diameter of toner particles. In addition, it is known that definition of the output images may also be changed depending on the electrophotographic photosensitive member.

An electrophotographic photosensitive member containing ammonia-reduced titanium oxide particles in an electrically conductive layer is disclosed in Japanese Patent Application Laid-Open No. H04-294363. Electrophotographic photosensitive members containing oxygen-deficient titanium oxide particles in an electrically conductive layer or an electro-conductive particle-dispersed layer have been disclosed in Japanese Patent Application Laid-Open Nos. H07-287475 and 2007-334334. Electrophotographic photosensitive members containing nitrogen-doped titanium oxide particles in an intermediate layer have been disclosed in Japanese Patent Application Laid-Open Nos. 2007-298568 and 2007-298569. An electrophotographic photosensitive member containing titanium dioxide particles in a first intermediate layer (corresponding to an electrically conductive layer in the present invention) has been disclosed in Japanese Patent Application Laid-Open No. 2002-107984.

According to the investigation by the present inventors, it was found that at the time of repeatedly performing image formation under a low-temperature and low-humidity environment, leakage may easily occur in the electrophotographic photosensitive members disclosed in Japanese Patent Application Laid-Open Nos. H04-294363, H07-287475, 2007-334334, 2007-298568, and 2007-298569. Here, leakage is a phenomenon that dielectric breakdown occurs in a local portion of an electrophotographic photosensitive member, and thus an excessive current flows in the portion. When leakage occurs, it is impossible to charge the electrophotographic photosensitive member sufficiently, which leads to image defects such as black spots, horizontal white stripes, horizontal black stripes, and the like.

Further, in the electrophotographic photosensitive member disclosed in Japanese Patent Application Laid-Open NO. 2002-107984, there is room for improvement in terms of definition in the output image.

SUMMARY OF THE INVENTION

An object of the present invention is to provide an electrophotographic photosensitive member in which leakage hardly occurs even in the case of using a layer containing metal oxide particles as an electrically conductive layer in the electrophotographic photosensitive member, and which is compatible with definition in output images.

The above-mentioned object may be achieved by the present invention described below. That is, an electrophotographic photosensitive member according to one embodiment of the present invention is an electrophotographic photosensitive member including a support, an electrically conductive layer and a photosensitive layer in this order, wherein the electrically conductive layer contains a binder material and particles represented by General Formula (1).

$$Nb_{2.00}O_{5.00-X}N_{Y} \quad (1)$$

(In Formula (1), Nb is a niobium atom, O is an oxygen atom, N is a nitrogen atom, and $0.00<Y<X\leq 4.00$.)

Further, the present invention provides a process cartridge capable of integrally supporting the electrophotographic photosensitive member and at least one unit selected from the group consisting of a charging unit, a developing unit, a transferring unit and a cleaning unit, and being attachable to and detachable from a main body of an electrophotographic apparatus.

In addition, the present invention provides an electrophotographic apparatus having the electrophotographic photosensitive member, and a charging unit, an exposing unit, a developing unit and a transferring unit.

Further features of the present invention will become apparent from the following description of exemplary embodiments with reference to the attached drawings.

DESCRIPTION OF THE EMBODIMENTS

Figure 1:
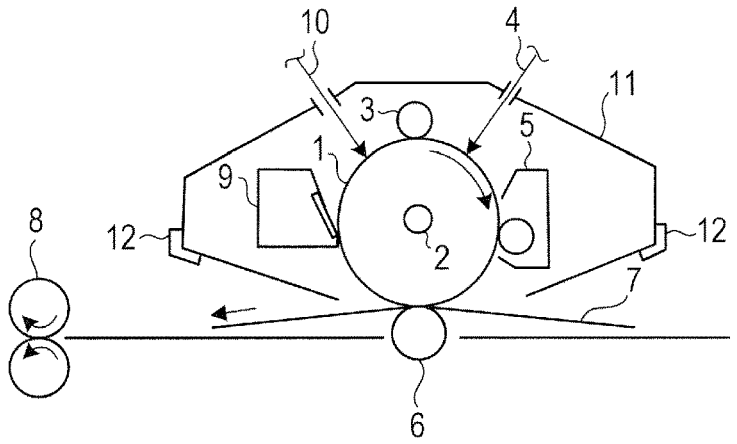
FIG. 1 is a view illustrating an example of a schematic configuration of an electrophotographic apparatus including a process cartridge having an electrophotographic photosensitive member.

Hereinafter, the present invention will be described in detail with reference to preferable embodiments thereof.

As a result of investigation by the present inventors, it was found that since it was impossible to form an electrically conductive layer having suitable electric resistance in the related art disclosed in Japanese Patent Laid-Open Publication Nos. H04-294363, H07-287475, 2007-334334, 2007-298568 and 2007-298569, at the time of repeatedly performing image formation under a low-temperature and low-humidity environment, leakage may easily occur in an electrophotographic photosensitive member.

In addition, it is known that image exposure light incident on a photosensitive layer of the electrophotographic photosensitive member may be reflected at a lower layer of the photosensitive layer (a layer present after the image exposure light passes through the photosensitive layer) or an interface with a support, and at the same time the image exposure light may be scattered in the lower layer of the photosensitive layer. As a result of investigation by the present inventors, it was found that in the related art disclosed in Japanese Patent Application Laid-Open No. 2002-107984, there was a technical problem in that an irradiation range of image exposure light to the photosensitive layer was substantially increased by reflection or scattering as described above, such that definition of latent images was deteriorated, which resulted in deterioration of definition of output images.

In order to solve the technical problems in the related art, the present inventors conducted an investigation into particles used as a conductive material of an electrically conductive layer (hereinafter, referred to as 'metal oxide particles'). As a result of the investigation, it may be appreciated that the technical problem in the related art may be solved by using particles represented by the following General Formula (1).

$$Nb_{2.00}O_{5.00-X}N_Y \quad (1)$$

(In Formula 1, Nb is a niobium atom, O is an oxygen atom, N is a nitrogen atom, and $0.00<Y<X\leq 4.00$.)

The present invention is characterized in that niobium oxide particles contained in the electrically conductive layer have oxygen-deficient portion together with a nitrogen-doped portion. Meanwhile, in a case in which the niobium oxide particles have only the nitrogen-doped portion without the oxygen-deficient portion, in Formula (1), X is equal to Y (X=Y), and in a case in which the niobium oxide particles have only the oxygen-deficient portion without the nitrogen-doped portion, in Formula (1), Y is 0 (Y=0). However, in both cases, it is impossible to obtain the effect of the present invention. Regarding this difference, the present inventors presume as follows.

In the present invention, the niobium oxide particles have the oxygen-deficient portion and the nitrogen-doped portion, such that electrical properties different from those of niobium oxide particles that are not reduced are exhibited, and as a result, the niobium oxide particles have resistance suitable for being used in the electrically conductive layer. Further, optical changes such as a decrease in refractive index and an increase in absorption with respect to the image exposure light occur. As a result, it is estimated that since in the electrically conductive layer, reflection or scattering from the lower layer of the photosensitive layer is decreased and expansion of an irradiation range of the image exposure light to the photosensitive layer is suppressed, definition of latent images is increased, such that definition of output images is improved.

Meanwhile, in a case of using niobium oxide particles having a high reduction ratio ($x>4.00$), leakage resistance may not be sufficiently improved. When the reduction ratio is high, the niobium oxide particles become particles having low powder resistivity, and an amount of charges flowing through one conductive path in an electrically conductive layer made of these particles is increased. As a result, the reason may be that locally, excessive current may easily flow.

As in the above-mentioned mechanism, the respective configurations have synergic influences on each other, thereby making it possible to achieve the effect of the present invention.

[Electrophotographic Photosensitive Member]

An electrophotographic photosensitive member according to one embodiment of the present invention includes a support, an electrically conductive layer and a photosensitive layer.

As a method of manufacturing the electrophotographic photosensitive member according to one embodiment of the present invention, a method of preparing coating liquids of respective layers to be described below, applying the coating liquids in a desired sequence of the layers, and drying the applied coating liquids may be used. Here, examples of a coating method of the coating liquid may include a dip coating method, a spray coating method, an inkjet coating method, a roll coating method, a die coating method, a blade coating method, a curtain coating method, a wire bar coating method, a ring coating method, and the like. Among them, in view of efficiency and productivity, the dip coating method is preferable. Hereinafter, the support and each of the layers will be described.

<Support>

In the present invention, the electrophotographic photosensitive member includes the support. In the present invention, it is preferable that the support is a conductive support having electro-conductivity. Further, the support may have a cylindrical shape, a belt shape, a sheet shape, or the like. Among them, a cylindrical support is preferable. Further, electrochemical treatment such as anodic oxidation, or the like, blasting treatment, centerless polishing treatment, cutting treatment, or the like, may be performed on a surface of the support.

As a material of the support, a metal, a resin, glass, or the like, is preferable.

Examples of the metal may include aluminum, iron, nickel, copper, gold, stainless steel, an alloy thereof, and the like. Among them, an aluminum support made of aluminum is preferable.

In addition, the resin or glass may be mixed or coated with an electro-conductive material, or the like, thereby making it possible to impart electro-conductivity.

<Electrically Conductive Layer>

In the present invention, the electrically conductive layer is provided on the support. Scratches or unevenness of the surface of the support may be concealed or reflection of light in the surface of the support may be controlled by providing the electrically conductive layer.

The electrically conductive layer contains particles represented by General Formula (1) and a binder material.

The particles represented by General Formula (1) according to the present invention are obtained by heating and reducing niobium oxide particles (for example, niobium pentoxide ($Nb_2O_5$) particles) under an ammonia gas atmosphere. As the niobium oxide particles, niobium oxide particles having various shapes such as a spherical shape, a polyhedral shape, an ellipsoid shape, a flaky shape, a needle shape, and the like, may be used. Among them, the niobium oxide particles having the spherical shape, the polyhedral shape, and the ellipsoid shape are preferable in that images defects such as black spots, or the like, are small. Niobium oxide particles having the spherical shape or the polyhedral shape close to the spherical shape are more preferable.

The particles have an oxygen-deficient portion represented by X-Y and a nitrogen-doped portion represented by Y. X and Y need to satisfy $0.00<Y<X\leq4.00$. Further, it is preferable that Y is 0.10 or more. In addition, it is preferable that X is 1.50 or less. Further, it is preferable that X-Y is 0.10 or more.

It is preferable that the particles have a peak at a Bragg angle ($2\theta\pm0.1°$) of 41.8 to 42.1° in CuKα characteristic X-ray diffraction. Appearance of this peak is derived from a cubic crystal structure composed of NbO and NbN.

It is preferable that an average primary particle diameter ($D_1$) of the particles is 40 nm or more to 300 nm or less. When the average primary particle diameter of the particles is 40 nm or more, re-aggregation of the particles hardly occurs after preparing an electrically conductive layer coating liquid. When re-aggregation of the particles occurs, stability of the electrically conductive layer coating liquid may be deteriorated, or cracks may occur in a surface of the electrically conductive layer to be formed. When the average primary particle diameter of the particles is 300 nm or less, it is difficult to allow the surface of the electrically conductive layer to be rough. When the surface of the electrically conductive layer becomes rough, local charge injection into the photosensitive layer may easily occur, such that black spots in a white background of the output image easily become noticeable.

In the present invention, the average primary particle diameter $D_1$ [μm] of the particles is obtained using a scanning electron microscope as follows. The average primary particle diameter $D_1$ [μm] of the particles was obtained by observing measurement target particles using a scanning electron microscope (trade name: S-4800, Hitachi Ltd.), measuring individual particle diameters of 100 particles in an image obtained by observation, and calculating an arithmetic average thereof. The individual particle diameter was (a+b)/2 in which a is a length of a longest side of a primary particle and b is a length of a shortest side thereof.

It is preferable that powder resistivity of the particles is in a range of $2.0\times10^1$ Ω·cm or more. The powder resistivity of the particles is in the above-mentioned range, which is preferable in view of leakage resistance. Further, the powder resistivity of the particles is measured in an environment of room temperature and normal humidity (23° C./50% RH). In the present invention, as a measurement apparatus, a resistivity meter (trade name: LORESTA GP, Mitsubishi Chemical Corporation) was used. The particles corresponding to a measurement target were compacted at a pressure of 500 kg/cm$^2$, such that a pellet-shaped measurement sample was prepared. An applied voltage was 100V.

The surfaces of the particles may also be treated with a silane coupling agent, or the like.

It is preferable that the particles are contained in the electrically conductive layer in a content of 20 vol % or more to 50 vol % or less based on an entire volume of the electrically conductive layer. When the content of the particles in the electrically conductive layer is less than vol % based on the entire volume of the electrically conductive layer, a distance between the particles tends to be increased. As the distance between the particles is increased, volume resistivity of the electrically conductive layer tends to be increased. In this case, a flow of charges is likely to stagnate at the time of image formation, such that a residual potential tends to be increased, and a change in dark portion potential or light portion potential tends to occur easily. When the content of the particles in the electrically conductive layer is more than 50 vol % based on the entire volume of the electrically conductive layer, the particles are likely to come in contact with each other. Contact portions of the particles become portions where the volume resistivity of the electrically conductive layer is locally low, so that leakage easily occurs in the electrophotographic photosensitive member.

It is more preferable that the particles are contained in the electrically conductive layer in a content of 30 vol % or more to 45 vol % or less based on the entire volume of the electrically conductive layer.

The electrically conductive layer may further contain other electro-conductive particles. Examples of a material of other electro-conductive particles may include a metal oxide, a metal, carbon black, and the like. Examples of the metal oxide may include zinc oxide, aluminum oxide, indium oxide, silicon oxide, zirconium oxide, tin oxide, titanium oxide, magnesium oxide, antimony oxide, bismuth oxide, and the like. Examples of the metal may include aluminum, nickel, iron, nichrome, copper, zinc, silver, and the like. In a case of using metal oxide particles as other electro-conductive particles, surfaces of the metal oxide particles may be treated with a silane coupling agent, or the like. Alternatively, the surfaces of the metal oxide particles may also be doped with an element such as phosphorus, aluminum, or the like, or an oxide thereof.

In addition, other electro-conductive particles may have a multilayer structure including a core material particle and a coating layer covering the core material particle. Examples of a material of the core material particle may include titanium oxide, barium oxide, zinc oxide, and the like. Examples of a material used in the coating layer may include metal oxides such as tin oxide, and the like.

In a case of using the metal oxide particles as other electro-conductive particles, the metal oxide particles have an average particle diameter of preferably 1 nm or more to 500 nm or less, and more preferably 3 nm or more to 400 nm or less.

Examples of the binder material may include a polyester resin, a polycarbonate resin, a polyvinyl acetal resin, an acrylic resin, a silicone resin, an epoxy resin, a melamine resin, a polyurethane resin, a phenol resin, an alkyd resin, and the like. As the binder material, a thermosetting phenol resin or a thermosetting polyurethane resin is preferable. In a case of using a thermosetting resin as the binder material of the electrically conductive layer, a binder material contained in the electrically conductive layer coating liquid is a monomer and/or an oligomer of the thermosetting resin.

Further, the electrically conductive layer may further contain silicone oil, resin particles, and the like.

An average film thickness of the electrically conductive layer is preferably 0.5 μm or more to 50 μm or less, more preferably 1 μm or more to 40 μm or less, and particularly preferably 5 μm or more to 35 μm or less.

The electrically conductive layer may be formed by preparing the electrically conductive layer coating liquid containing the above-mentioned materials and a solvent to form a coating film, and drying the coating film. Examples of the solvent used in the coating liquid may include an alcohol based solvent, a sulfoxide based solvent, a ketone based solvent, an ether based solvent, an ester based solvent, an aromatic hydrocarbon based solvent, and the like. As a dispersion method for dispersing the electro-conductive particles in the electrically conductive layer coating liquid, methods using a paint shaker, a sand mill, a ball mill, a liquid collision high speed disperser, and the like, may be used.

The volume resistivity of the electrically conductive layer is preferably $1.0\times10^{5}$ Ω·cm or more to $5.0\times10^{12}$ Ω·cm or less. When the volume resistivity of the electrically conductive layer is $5.0\times10^{12}$ Ω·cm or less, the flow of charges hardly stagnates at the time of image formation, the residual potential hardly rises, and a change in dark portion potential and light portion potential hardly occurs. Meanwhile, when the volume resistivity of the electrically conductive layer is $1.0\times10^{5}$ Ω·cm or more, an excessive increase in amount of charges flowing in the electrically conductive layer at the time of charging the electrophotographic photosensitive member hardly occurs, such that leakage will hardly occur. It is more preferable that the volume resistivity of the electrically conductive layer is $1.0\times10^{5}$ Ω·cm or more to $1.0\times10^{11}$ Ω·cm or less.

Figure 2:
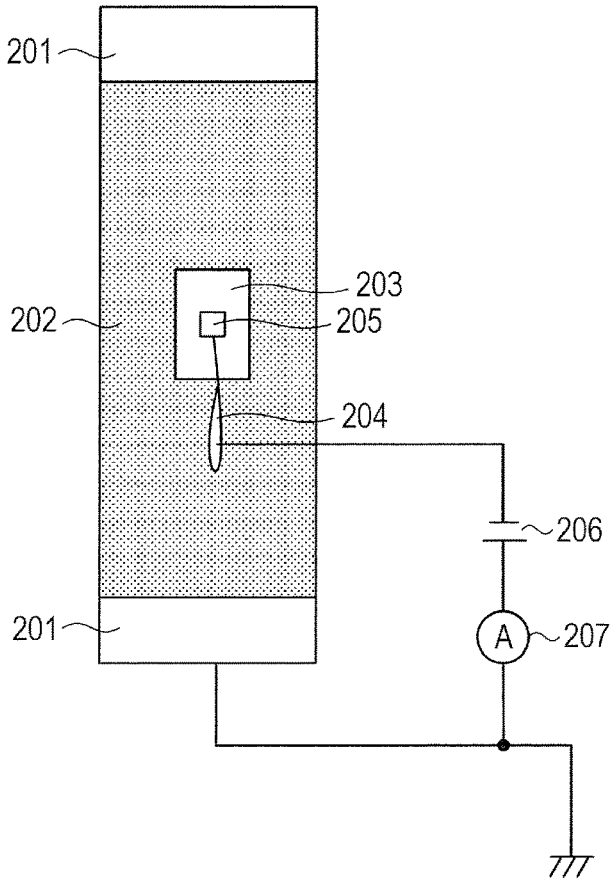
FIG. 2 is a top view for explaining a method of measuring volume resistivity of an electrically conductive layer.
Figure 3:
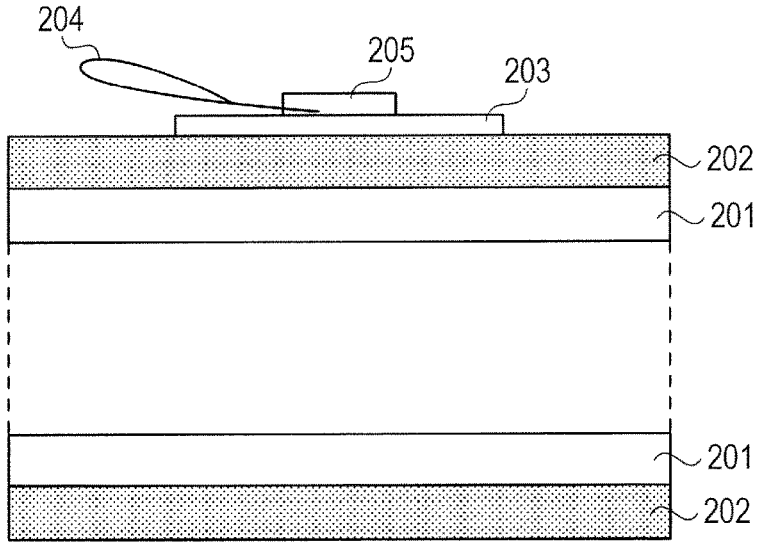
FIG. 3 is a cross-sectional view for explaining the method of measuring volume resistivity of the electrically conductive layer.

A method of measuring volume resistivity of the electrically conductive layer of the electrophotographic photosensitive member will be described with reference to FIGS. 2 and 3. FIG. 2 is a top view for explaining the method of measuring volume resistivity of the electrically conductive layer, and FIG. 3 is a cross-sectional view for explaining the method of measuring volume resistivity of the electrically conductive layer. The volume resistivity of the electrically conductive layer is measured in an environment of room temperature and normal humidity (23° C./50% RH). A copper tape 203 (product No. 1181, Sumitomo 3M Ltd.) is attached to a surface of an electrically conductive layer 202, and the attached copper tape is used as an electrode on a surface side of the electrically conductive layer 202. Further, a support 201 is used as an electrode on a back side of the electrically conductive layer 202. A power supply 206 for applying a voltage between the copper tape 203 and the support 201 and a current measurement device 207 for measuring a current flowing between the copper tape 203 and the support 201 are installed respectively. Further, in order to apply the voltage to the copper tape 203, a copper wire 204 is placed on the copper tape 203. A copper wire fixing copper tape 205 which is the same as the copper tape 203 is attached from above the copper wire 204 so that the copper wire 204 does not protrude from the copper tape 205, thereby fixing the copper wire 204 to the copper tape 203. The voltage is applied to the copper tape 203 using the copper wire 204. A background current value when the voltage is not applied between the copper tape 203 and the support 201 is $I_0$ [A], and a current value when only a direct current (DC) voltage (direct current component) of −1V is applied is I [A]. Further, a film thickness of the electrically conductive layer 202 is d [cm], and an area of the electrode (the copper tape 203) on the surface side of the electrically conductive layer 202 is S [$cm^2$]. In this case, a value represented by the following Equation (1) is a volume resistivity ρ [Ω cm] of the electrically conductive layer 202.

$$\rho=1/(I-I_0)\times S/d[\Omega\cdot\text{cm}] \quad (I)$$

In this measurement, it is preferable to use a device capable of measuring a minute current as the current measurement device 207 in order to measure a minute current amount of $1\times10^{-6}$ A or less in absolute value. As such a device, a pA meter (trade name: 4140B, Yokogawa Hewlett-Packard Co. Ltd.), or the like, may be used. Further, even when measurement is performed in a state in which only the electrically conductive layer is formed on the support or in a state in which each of the layers (the photosensitive layer, etc.) on the electrically conductive layer is delaminated from the electrophotographic photosensitive member and only the electrically conductive layer remains on the support, a measurement value of the volume resistivity of the electrically conductive layer is equal.

<Undercoat Layer>

According to the present invention, an undercoat layer may be provided on the electrically conductive layer. An adhesion function between the layers is enhanced by providing the undercoat layer, thereby making it possible to impart a charge injection preventing function.

It is preferable that the undercoat layer contains a resin. Further, the undercoat layer may be formed as a cured film by polymerizing a composition containing a monomer having a polymerizable functional group.

Examples of the resin may include a polyester resin, a polycarbonate resin, a polyvinyl acetal resin, an acrylic resin, an epoxy resin, a melamine resin, a polyurethane resin, a phenol resin, a polyvinylphenol resin, an alkyd resin, a polyvinylalcohol resin, a polyethylene oxide resin, a polypropylene oxide resin, a polyamide resin, a polyamic acid resin, a polyimide resin, a polyamideimide resin, a cellulose resin, and the like.

Examples of the polymerizable functional group of the monomer having a polymerizable functional group may include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group, a carbon-carbon double bond group, and the like.

Further, in order to improve electric properties, the undercoat layer may further contain an electron transporting material, a metal oxide, a metal, an electro-conductive polymer, or the like. Among them, the electron transporting material and the metal oxide may be preferably used.

Examples of the electron transporting material may include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, a boron-containing compound, and the like. The undercoat layer may also be formed as a cured film by using an electron transporting material having a polymerizable functional group as the electron transporting material and copolymerizing with the monomer having a polymerizable functional group described above.

Examples of the metal oxide may include indium tin oxide, tin oxide, indium oxide, titanium oxide, zinc oxide, aluminum oxide, silicon dioxide, and the like. Examples of the metal may include gold, silver, aluminum, and the like.

Further, the undercoat layer may further contain an additive.

An average film thickness of the undercoat layer is preferably 0.1 μm or more to 50 μm or less, more preferably 0.2 μm or more to 40 μm or less, and particularly preferably 0.3 μm or more to 30 μm or less.

The undercoat layer may be formed by preparing an undercoat layer coating liquid containing the above-mentioned materials and a solvent to form a coating film, and drying and/or curing the coating film. Examples of the solvent used in the coating liquid may include an alcohol based solvent, a ketone based solvent, an ether based solvent, an ester based solvent, an aromatic hydrocarbon based solvent, and the like.

<Photosensitive Layer>

The photosensitive layer of the electrophotographic photosensitive member is mainly classified into (1) a laminate type photosensitive layer and (2) a monolayer type photosensitive layer. (1) The laminate type photosensitive layer has a charge generating layer containing a charge generating material, and a charge transporting layer containing a charge transporting material. (2) The monolayer type photosensitive layer has a photosensitive layer simultaneously containing a charge generating material and a charge transporting material.

(1) Laminate Type Photosensitive Layer

The laminate type photosensitive layer has the charge generating layer and the charge transporting layer.

(1-1) Charge Generating Layer

It is preferable that the charge generating layer contains the charge generating material and a resin.

Examples of the charge generating material may include azo pigments, perylene pigments, polycyclic quinone pigments, indigo pigments, phthalocyanine pigments, and the like. Among them, the azo pigments and the phthalocyanines pigment are preferable. Among the phthalocyanine pigments, an oxytitanium phthalocyanine pigment, a chlorogallium phthalocyanine pigment, and a hydroxygallium phthalocyanine pigment are preferable.

A content of the charge generating material in the charge generating layer is preferably 40 mass % or more to 85 mass % or less, and more preferably 60 mass % or more to 80 mass % or less based on an entire mass of the charge generating layer.

Examples of the resin may include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, a polyvinyl chloride resin, and the like. Among them, the polyvinyl butyral resin is more preferable.

Further, the charge generating layer may also further contain an additive such as an antioxidant, a UV absorber, or the like. Specific examples of the additive may include a hindered phenol compound, a hindered amine compound, a sulfur compound, a phosphorus compound, a benzophenone compound, and the like.

An average film thickness of the charge generating layer is preferably 0.1 μm or more to 1 μm or less, and more preferably 0.15 μm or more to 0.4 μm or less.

The charge generating layer may be formed by preparing a charge generating layer coating liquid containing the above-mentioned materials and a solvent to form a coating film, and drying the coating film. Examples of the solvent used in the coating liquid may include an alcohol based solvent, a sulfoxide based solvent, a ketone based solvent, an ether based solvent, an ester based solvent, an aromatic hydrocarbon based solvent, and the like.

(1-2) Charge Transporting Layer

It is preferable that the charge transporting layer contains the charge transporting material and a resin.

Examples of the charge transporting material may include a polycyclic aromatic compound, a heterocyclic compound, a hydrazone compound, a styryl compound, an enamine compound, a benzidine compound, a triarylamine compound, a resin having a group derived from these materials, and the like. Among them, the triarylamine compound and the benzidine compound are preferable.

A content of the charge transporting material in the charge transporting layer is preferably 25 mass % or more to 70 mass % or less, and more preferably 30 mass % or more to 55 mass % or less based on an entire mass of the charge transporting layer.

Examples of the resin may include a polyester resin, a polycarbonate resin, an acrylic resin, a polystyrene resin, and the like. Among them, the polycarbonate resin and the polyester resin are preferable. As the polyester resin, particularly, a polyarylate resin is preferable.

A content ratio (mass ratio) of the charge transporting material and the resin is preferably 4:10 to 20:10, and more preferably 5:10 to 12:10.

Further, the charge transporting layer may also contain an additive such as an antioxidant, a UV absorber, a plasticizer, a labeling agent, a slipperiness-imparting agent, a wear-resistance improver, or the like. Specific examples of the additive may include a hindered phenol compound, a hindered amine compound, a sulfur compound, a phosphorus compound, a benzophenone compound, a siloxane modified resin, silicone oil, fluororesin particles, polystyrene resin particles, polyethylene resin particles, silica particles, alumina particles, boron nitride particles, and the like.

An average film thickness of the charge transporting layer is preferably 5 μm or more to 50 μm or less, more preferably 8 μm or more to 40 μm or less, and particularly preferably 9 μm or more to 30 μm or less.

The charge transporting layer may be formed by preparing a charge transporting layer coating liquid containing the above-mentioned materials and a solvent to form a coating film, and drying the coating film. Examples of the solvent used in the coating liquid may include an alcohol based solvent, a ketone based solvent, an ether based solvent, an ester based solvent, an aromatic hydrocarbon based solvent, and the like. Among them, the ester based solvent or the aromatic hydrocarbon based solvent is preferable.

(2) Monolayer Type Photosensitive Layer

The monolayer type photosensitive layer may be formed by preparing a photosensitive layer coating liquid containing a charge generating material, a charge transporting material, a resin, and a solvent to form a coating film, and drying the coating film. Examples of the charge generating material, the charge transporting material, and the resin are the same as those described by way of example in '(1) laminate type photosensitive layer'.

<Protection Layer>

According to the present invention, a protection layer may be provided on the photosensitive layer. Durability may be improved by providing the protection layer.

It is preferable that the protection layer contains electro-conductive particles and/or a charge transporting material and a resin.

Examples of the electro-conductive particles may include metal oxide particles such as titanium oxide particles, zinc oxide particles, tin oxide particles, indium oxide particles, and the like.

Examples of the charge transporting material may include a polycyclic aromatic compound, a heterocyclic compound, a hydrazone compound, a styryl compound, an enamine compound, a benzidine compound, a triarylamine compound, a resin having a group derived from these materials, and the like. Among them, the triarylamine compound and the benzidine compound are preferable.

Examples of the resin may include a polyester resin, an acrylic resin, a phenoxy resin, a polycarbonate resin, a polystyrene resin, a phenol resin, a melamine resin, an epoxy resin, and the like. Among them, the polycarbonate resin, the polyester resin, and the acrylic resin are preferable.

Further, the protection layer may be formed as a cured film by polymerizing a composition containing a monomer having a polymerizable functional group. In this case, examples of a reaction may include a thermal polymerization reaction, a photopolymerization reaction, a radiation polymerization reaction, and the like. Examples of the polymerizable functional group of the monomer having a polymerizable functional group may include an acryl group, a methacryl group, and the like. As the monomer having a polymerizable functional group, a material having a charge transporting ability may also be used.

The protection layer may also contain an additive such as an antioxidant, a UV absorber, a plasticizer, a labeling agent, a slipperiness-imparting agent, a wear-resistance improver, or the like. Specific examples of the additive may include a hindered phenol compound, a hindered amine compound, a sulfur compound, a phosphorus compound, a benzophenone compound, a siloxane modified resin, silicone oil, fluororesin particles, polystyrene resin particles, polyethylene resin particles, silica particles, alumina particles, boron nitride particles, and the like.

An average film thickness of the protection layer is preferably 0.5 μm or more to 10 μm or less, and more preferably 1 μm or more to 7 μm or less.

The protection layer may be formed by preparing a protection layer coating liquid containing the above-mentioned materials and a solvent to form a coating film, and drying and/or curing the coating film. Examples of the solvent used in the coating liquid may include an alcohol based solvent, a ketone based solvent, an ether based solvent, a sulfoxide based solvent, an ester based solvent, an aromatic hydrocarbon based solvent, and the like.

[Process Cartridge, Electrophotographic Apparatus]

The process cartridge according to one embodiment of the present invention integrally supports the above-mentioned electrophotographic photosensitive member and at least one unit selected from the group consisting of a charging unit, a developing unit, a transferring unit, and a cleaning unit, and are attachable to and detachable from a main body of the electrophotographic apparatus.

In addition, the electrophotographic apparatus according to one embodiment of the present invention includes the electrophotographic photosensitive member described above, and a charging unit, an exposing unit, a developing unit, and a transferring unit.

FIG. 1 is a view illustrating an example of a schematic configuration of an electrophotographic apparatus including a process cartridge having an electrophotographic photosensitive member.

Reference numeral 1 indicates a cylindrical electrophotographic photosensitive member, which is rotationally driven at a predetermined peripheral speed in an arrow direction around a shaft 2. A surface of the electrophotographic photosensitive member 1 is charged to a predetermined positive or negative potential by a charging unit 3. Further, although a roller charging method using a roller type charging member is illustrated in FIG. 1, a charging method such as a corona charging method, a proximity charging method, an injection charging method, or the like, may also be adopted. A surface of the charged electrophotographic photosensitive member 1 is irradiated with an exposure light 4 by an exposing unit (not illustrated), such that an electrostatic latent image corresponding to image information of a target is formed. The electrostatic latent image formed on the surface of the electrophotographic photosensitive member 1 is developed with a toner accommodated in a developing unit 5, such that a toner image is formed on the surface of the electrophotographic photosensitive member 1. The toner image formed on the surface of the electrophotographic photosensitive member 1 is transferred to a transferring material 7 by a transferring unit 6. The transferring material 7 to which the toner image has been transferred is transported to a fixing unit 8, thereby fixing the toner image. Then, an image formed from the toner image is printed out to the outside of the electrophotographic apparatus. The electrophotographic apparatus may also have a cleaning unit 9 for removing deposits such as the toner remaining on the surface of the electrophotographic photosensitive member 1 after transferring, and the like. A so-called cleaner-less system for removing the deposits using a developing unit, or the like, without separately providing the cleaning unit may be used. The electrophotographic apparatus may have an electricity removing mechanism for removing electricity on the surface of the electrophotographic photosensitive member 1 with pre-exposure light 10 from a pre-exposure unit (not illustrated). In addition, in order to attach the process cartridge 11 according to one embodiment of the present invention to a main body of the electrophotographic apparatus or detach the process cartridge 11 therefrom, a guide unit 12 such as a rail, or the like, may also be provided.

The electrophotographic photosensitive member according to one embodiment of the present invention may be used in a laser beam printer, a LED printer, a copying machine, facsimile, and a multifunctional machine thereof, etc.

According to the exemplary embodiment of the present invention, it is possible to provide an electrophotographic photosensitive member in which leakage hardly occurs even in the case of using a layer containing metal oxide particles as an electrically conductive layer in the electrophotographic photosensitive member, and which is compatible with definition in output images.

EXAMPLE

Hereinafter, the present invention will be described in more detail through the Example and the Comparative Example. The present invention is not limited to the following Example as long as the gist of the present invention is not deviated. Further, in the description of the following Examples, "part" is on a mass basis unless otherwise specified.

[Preparation Example of Particles]

(Preparation Example of Particle 1)

Niobium pentoxide fine powder having an average primary particle diameter of 60 nm was subjected to reduction treatment at 700° C. for 6 hours under an ammonia gas flow at a linear flow rate of 3 cm/sec. Continuously, 10% hydrochloric acid aqueous solution was added to the obtained powder, stirred, and allowed to stand. The obtained supernatant was removed, decantation with water was performed two times, and the filtered filtrate was dried. The obtained filtrate was subjected to a pulverization process, thereby obtaining powder of particles 1 having an average primary particle diameter of 60 nm. An element ratio of the obtained particles was analyzed by the following electron spectroscopy for chemical analysis (ESCA). Measurement conditions were as follows.

<ESCA Analysis>

Used device: VersaProbe II manufactured by ULVAC-PHI Inc.

X-ray source: Al Ka1486.6 eV (25 W15 kV)

Measurement area: φ100 μm

Spectral region: 300×200 μm, angle of 45°

Pass Energy: 58.70 eV

Step Size: 0.125 eV

A surface atomic concentration (atoms %) is calculated from a peak intensity of each element measured under the above conditions using a relative sensitivity factor provided by ULVAC-PHI Inc. A measurement peak top range of each element adopted is as follows.

O: energy of photoelectrons derived from a 1s electron orbital: 525 to 545 eV

N: energy of photoelectrons derived from a 1s electron orbital: 390 to 410 eV

Nb: energy of photoelectrons derived from a 2p electron orbital: 197 to 217 eV

Further, in order to remove influences of surface contamination, Ar ion sputtering was carried out at an intensity of 0.5 to 4.0 kV, and then measurement was carried out.

Figure 4:
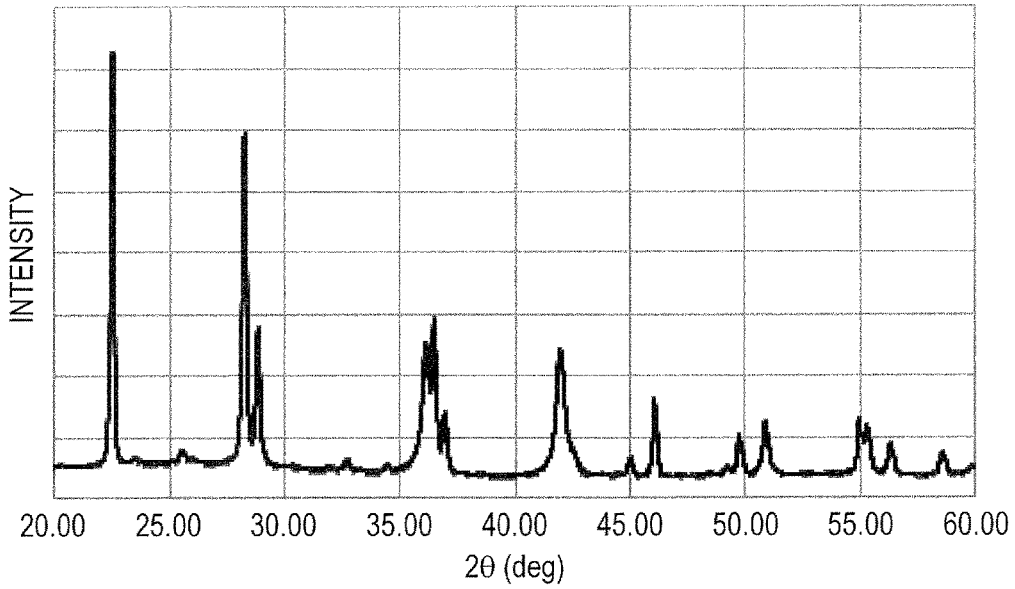
FIG. 4 is a powder X-ray diffraction pattern of particles obtained in Example.
Figure 5:
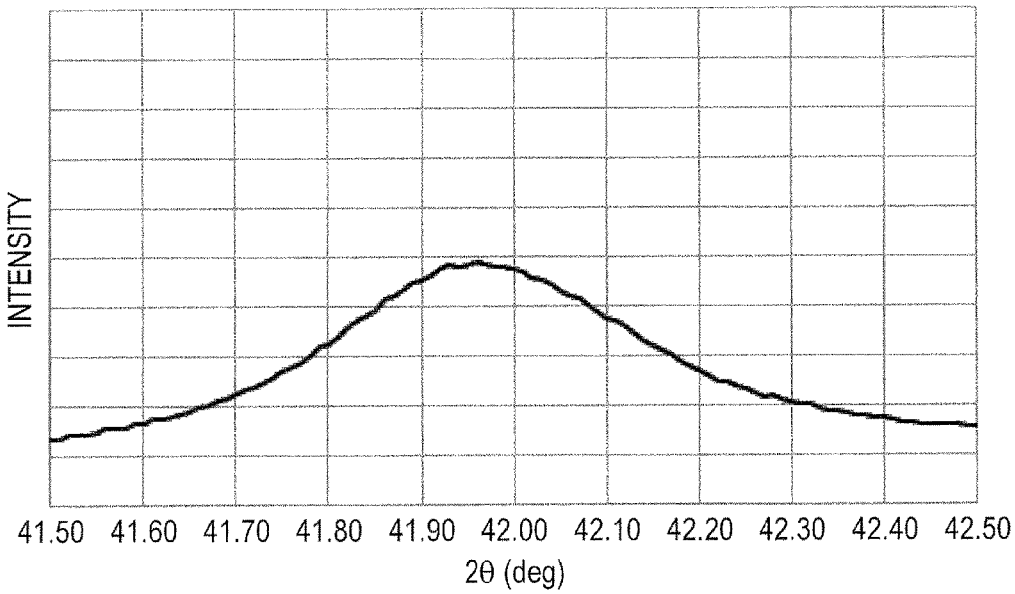
FIG. 5 is an enlarged view of the powder X-ray diffraction pattern of the particles obtained in Example.

In addition, powder X-ray diffraction patterns of the obtained particles were illustrated in FIGS. 4 and 5. Further, powder X-ray diffraction was measured under the following conditions.

<Measurement of Powder X-Ray Diffraction>

Used measurement device: X-ray diffraction apparatus (Smart Lab) manufactured by Rigaku Corp.

X-ray tube: Cu

Tube voltage: 45 KV

Tube current: 200 mA

Optical system: CBO

Scanning method: 2θ/θ scan

Mode: continuous

Range specification: absolute

Counting time: 10

Sampling interval: 0.01°

Start angle (2θ): 5.0°

Stop angle (2θ): 60.0°

IS: 1/2

RS1: 20 mm

RS2: 20 mm

Attenuator: Open

Attachment: Standard Z stage (Preparation Examples of Particles 2 to 13 and C2)

Powders of particles 2 to 13 and C2 were obtained in the same manner in Preparation Examples of the particle 1 as illustrated in Table 1, except for changing the average primary particle diameter of base powders used to prepare the particle 1 and the conditions during the reduction treatment.

(Preparation Example of Particle C1)

Figure 6:
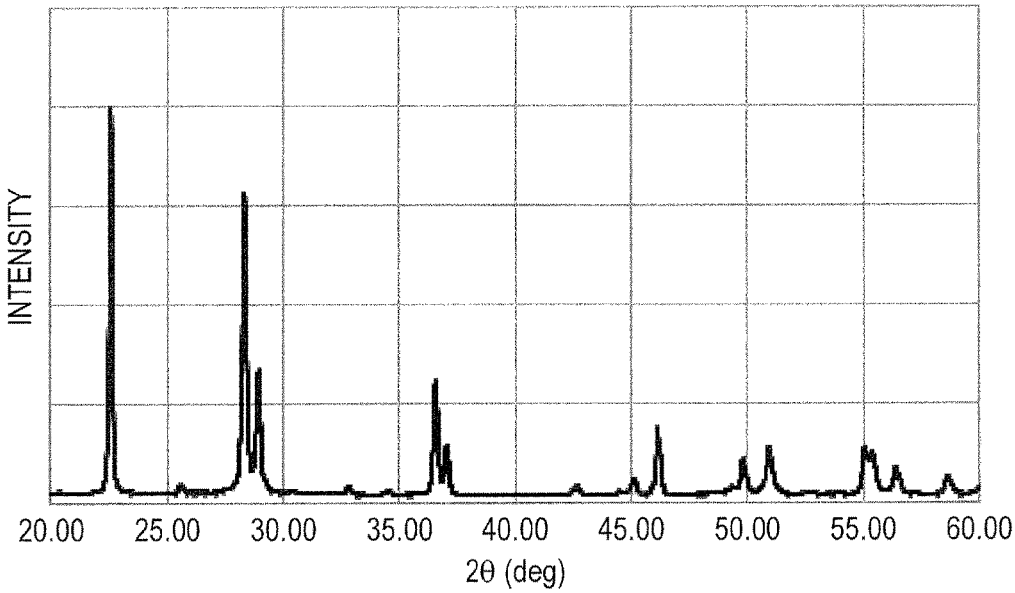
FIG. 6 is a powder X-ray diffraction pattern of particles obtained in Comparative Example.
Figure 7:
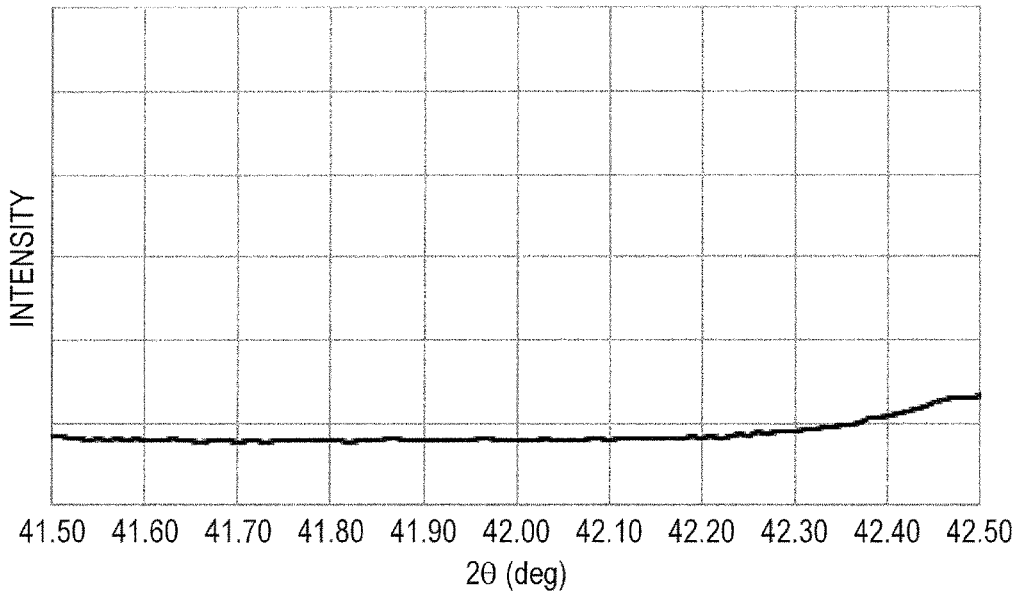
FIG. 7 is an enlarged view of the powder X-ray diffraction pattern of the particles obtained in Comparative Example.

Particle C1 was obtained using the niobium pentoxide ($Nb_2O_5$) fine powder used to prepare the particle 1. A powder X-ray diffraction pattern of C1 is illustrated in FIGS. 6 and 7.

Powder resistivities of the obtained particles 1 to 13, C1, and C2 were illustrated in Table 1.

TABLE 1

| Particle | X | Y | Presence or absence of X-ray diffraction peak | Average primary particle diameter nm | Powder resistivity Ω cm |
|---|---|---|---|---|---|
| 1 | 1.16 | 0.78 | Presence | 60 | $3.4 \times 10^2$ |
| 2 | 2.50 | 1.72 | Presence | 60 | $2.0 \times 10^1$ |
| 3 | 3.40 | 1.90 | Presence | 60 | $2.7 \times 10^0$ |
| 4 | 4.00 | 1.96 | Presence | 60 | $1.4 \times 10^0$ |
| 5 | 1.50 | 0.94 | Presence | 60 | $3.6 \times 10^1$ |
| 6 | 0.10 | 0.09 | Presence | 60 | $8.5 \times 10^6$ |
| 7 | 0.08 | 0.05 | Presence | 60 | $9.1 \times 10^6$ |
| 8 | 1.04 | 0.78 | Presence | 40 | $3.4 \times 10^3$ |
| 9 | 0.91 | 0.75 | Presence | 300 | $1.8 \times 10^3$ |
| 10 | 1.10 | 0.80 | Presence | 30 | $5.8 \times 10^2$ |
| 11 | 0.89 | 0.76 | Presence | 320 | $1.1 \times 10^3$ |
| 12 | 3.95 | 1.99 | Absence | 60 | $2.0 \times 10^0$ |
| 13 | 0.82 | 0.75 | Presence | 60 | $9.1 \times 10^3$ |
| C1 | 0.00 | 0.00 | Absence | 60 | $>1.0 \times 10^8$ |
| C2 | 4.13 | 1.98 | Absence | 60 | $1.0 \times 10^0$ |

[Preparation Example of Electrically Conductive Layer Coating Liquid]

(Preparation Example of Electrically Conductive Layer Coating Liquid 1)

In a mixed solvent of methyl ethyl ketone (45 parts) and 1-butanol (85 parts), 15 parts of a butyral resin (trade name: BM-1, Sekisui Chemical Co., Ltd.) as a polyol resin and 15 parts of a blocked isocyanate resin (trade name: TPA-B80E, 80% solution, Asahi Kasei Corp.) were dissolved, thereby obtaining a solution.

To this solution, 78 parts of Particle 1 was added and put into a vertical sand mill using 120 parts of glass beads having an average particle diameter of 1.0 mm as a dispersion medium, followed by dispersion treatment at 23±3° C. and 1500 rpm (peripheral speed: 5.5 m/s) for 4 hours, thereby obtaining a dispersion solution. The glass beads were removed from this dispersion solution using a mesh. Silicone oil of 0.01 part (trade name: SH28 PAINT ADDITIVE, Toray Dow Corning Co., Ltd.) as a leveling agent and 5 parts of cross-linked polymethylmethacrylate (PMMA) particles (trade name: Techopolymer SSX-102, Sekisui Plastics Co., Ltd., average primary particle diameter: 2.5 μm) as a surface roughness imparting agent were added to and stirred with the dispersion solution obtained by removing the glass beads, followed by pressure-filtration using a PTFE filter paper (trade name: PF060, Advantec Toyo Kaisha, Ltd.), thereby preparing an electrically conductive layer coating liquid 1.

(Preparation Examples of Electrically Conductive Layer Coating Liquids 2 to 15 and C1 to C5)

Electrically conductive layer coating liquids 2 to 15 and C1 to C5 were prepared by the same operation as in Preparation Example of Electrically conductive layer coating liquid 1 except that the kind and amount (parts) of particles used in preparing the electrically conductive layer coating liquid were changed as illustrated in Table 2, respectively.

In addition, the following particles were used in electrically conductive layer coating liquids C3 to C5.

C3: Titanium oxide (product Number: JR405) manufactured by Tayca Corp.

C4: Titanium black (product number: 13M) manufactured by Mitsubishi Materials Corp.

C5: Phosphorus-doped tin oxide

TABLE 2

| Electrically conductive layer coating liquid | Particle | Particle (part) |
|---|---|---|
| 1 | Particle 1 | 78 |
| 2 | Particle 2 | 78 |
| 3 | Particle 3 | 117 |
| 4 | Particle 4 | 117 |
| 5 | Particle 5 | 78 |
| 6 | Particle 5 | 29 |
| 7 | Particle 5 | 176 |
| 8 | Particle 5 | 21 |
| 9 | Particle 6 | 78 |
| 10 | Particle 7 | 78 |
| 11 | Particle 8 | 78 |
| 12 | Particle 9 | 78 |
| 13 | Particle 10 | 78 |
| 14 | Particle 11 | 78 |
| 15 | Particle 12 | 78 |
| C1 | Particle Cl | 78 |
| C2 | Particle C2 | 78 |
| C3 | Titanium oxide JR405 | 75 |
| C4 | Titanium black 13M | 75 |
| C5 | Phosphorus-doped tin oxide | 122 |

(Preparation Example of Electrically Conductive Layer Coating Liquid 16)

A solution was obtained by dissolving 80 parts of a phenol resin (phenol resin monomer/oligomer) (trade name: Plyophen J-325, DIC Corporation, resin solid content: 60%) as a binding material in 80 parts of 1-methoxy-2-propanol as a solvent.

142 parts of Particle 1 was added to this solution and put into a vertical sand mill using 200 parts of glass beads having an average particle diameter of 1.0 mm as a dispersion medium, followed by dispersion treatment at a dispersion temperature of 23±3° C. and 1000 rpm (peripheral speed: 3.7 m/s) for 4 hours, thereby obtaining a dispersion solution. The glass beads were removed from this dispersion solution using a mesh. 0.015 parts of silicone oil (trade name: SH28 PAINT ADDITIVE, Toray Dow Corning Co., Ltd.) as a leveling agent and 15 parts of silicone resin particles (trade name: TOSPEARL 120, Momentive Performance Materials Inc., average particle diameter: 2 μm) as a surface roughness imparting agent were added to and stirred with the dispersion solution after removing the glass beads, followed by pressure-filtration using a PTFE filter paper (trade name: PF060, Advantec Toyo Kaisha, Ltd.), thereby preparing an electrically conductive layer coating liquid 16.

(Preparation Examples of Electrically Conductive Layer Coating Liquids 17 to 38)

Electrically conductive layer coating liquids 17 to 30 were prepared by the same operation as in Preparation Example of electrically conductive layer coating liquid 1 except that the kind and amount (parts) of particles used in preparing the conductive layer coating liquid were changed as illustrated in Table 3, respectively.

TABLE 3

| Electrically conductive layer coating liquid | Particle | Particle (part) |
|---|---|---|
| 16 | Particle 1 | 142 |
| 17 | Particle 2 | 142 |
| 18 | Particle 3 | 213 |
| 19 | Particle 4 | 213 |
| 20 | Particle 5 | 142 |
| 21 | Particle 5 | 53 |

TABLE 3-continued

| Electrically conductive layer coating liquid | Particle | Particle (part) |
|---|---|---|
| 22 | Particle 5 | 320 |
| 23 | Particle 5 | 38 |
| 24 | Particle 6 | 142 |
| 25 | Particle 7 | 142 |
| 26 | Particle 8 | 142 |
| 27 | Particle 9 | 142 |
| 28 | Particle 10 | 142 |
| 29 | Particle 11 | 142 |
| 30 | Particle 12 | 142 |

(Preparation Example of Particle S1)

Hydrous titanium oxide slurry obtained by hydrolyzing a titanyl sulfate aqueous solution was washed with an alkali aqueous solution.

Next, hydrochloric acid was added to the hydrous titanium oxide slurry and a pH thereof was adjusted to 0.7, thereby obtaining a titania sol dispersion solution.

A 1.1-fold molar amount of a strontium chloride aqueous solution was added to 2.0 mol of the titania sol dispersion solution (in terms of titanium oxide) in a reaction vessel, and purged with nitrogen gas. Further, pure water was added thereto so that a concentration of titanium oxide became 1.0 mol/L.

Next, after the resultant was stirred, mixed, and heated to 85° C., 800 mL of 5N sodium hydroxide aqueous solution was added thereto over 20 minutes while applying ultrasonic vibration thereto, and then a reaction was carried out for 20 minutes. After adding pure water (5° C.) to slurry after the reaction, and rapidly cooling the resultant to 30° C. or less, a supernatant was removed. Further, a hydrochloric acid aqueous solution (pH 5.0) was added to the slurry, stirred for 1 hour, and then repeatedly washed with pure water. In addition, the resultant was neutralized with sodium hydroxide, filtered using Nutsche, and washed with pure water. The obtained cake was dried, thereby obtaining particles S.

As a result of performing X-ray diffraction measurement of the prepared particles S, the particles S had a maximum peak at a position of $2\theta=32.20\pm0.20$ ($\theta$: Bragg angle) in CuK$\alpha$ characteristic X ray diffraction spectrum, and a full width at half maximum of the maximum peak was 0.28 deg. Further, an average primary particle diameter of the particles S was 50 nm.

Then, 100 parts of the prepared particles S was stirred and mixed with 500 parts of toluene, and 2 parts of N-2-(aminoethyl)-3-aminopropylmethyldimethoxysilane (trade name: KBM602, Shin-Etsu Chemical Co., Ltd.) was added thereto as a silane coupling agent, and stirred for 6 hours. Thereafter, toluene was distilled and removed under reduced pressure, and the resultant was heated and dried at 130° C. for 6 hours, thereby obtaining surface treated particles S1.

(Preparation Example of Electrically Conductive Layer Coating Liquid X1)

In a mixed solvent of methyl ethyl ketone (45 parts) and 1-butanol (85 parts), 15 parts of a butyral resin (trade name: BM-1, Sekisui Chemical Co., Ltd.) as a polyol resin and 15 parts of a blocked isocyanate resin (trade name: TPA-B80E, 80% solution, Asahi Kasei Corp.) were dissolved, thereby obtaining a solution.

78 parts of Particle 1 and 32 parts of Particle S1 were added to this solution and put into a vertical sand mill using 120 parts of glass beads having an average particle diameter of 1.0 mm as a dispersion medium, followed by dispersion treatment at 23±3° C. and 1500 rpm (peripheral speed: 5.5 m/s) for 4 hours, thereby obtaining a dispersion solution. The glass beads were removed from this dispersion solution using a mesh. 0.01 parts of silicone oil (trade name: SH28 PAINT ADDITIVE, manufactured by Toray Dow Corning Co., Ltd.) as a leveling agent and 5 parts of cross-linked polymethylmethacrylate (PMMA) particles (trade name: Techpolymer SSX-102, Sekisui Plastics Co., Ltd., average primary particle diameter: 2.5 μm) as a surface roughness imparting agent were added to and stirred with the dispersion solution after removing the glass beads, followed by pressure-filtration using a PTFE filter paper (trade name: PF060, Advantec Toyo Kaisha, Ltd.), thereby preparing an electrically conductive layer coating liquid X1.

(Preparation Example of Electrically Conductive Layer Coating Liquid X2)

In preparing the electrically conductive layer coating liquid X1, the mixed solvent of methyl ethyl ketone (45 parts) and 1-butanol (85 parts) was changed to a mixed solvent of methyl ethyl ketone (36 parts) and 1-butanol (68 parts). Further, a use amount of the particles S1 was changed from 32 parts to 4 parts. An electrically conductive layer coating liquid X2 was prepared in the same manner as in the electrically conductive layer coating liquid X1 except for the above-mentioned conditions.

<Manufacturing Example of Electrophotographic Photosensitive Member>

(Manufacturing Example of Electrophotographic Photosensitive Member 1)

An aluminum cylinder (JIS-A3003, aluminum alloy) having a length of 257 mm and a diameter of 24 mm, manufactured by a manufacturing method including an extrusion process and a drawing process, was used as a support.

An electrically conductive layer having a film thickness of 20 μm was formed by dip-coating the electrically conductive layer coating liquid 1 on the support under an environment of room temperature and normal pressure (23° C./50% RH), and drying and thermosetting the obtained coating film at 170° C. for 30 minutes. Volume resistivity of the electrically conductive layer measured by the above-mentioned method was $2\times10^{8}$ Ω·cm. The obtained film thickness and volume resistivity of the obtained electrically conductive layer were illustrated in Table 4.

Next, an undercoat layer coating liquid was prepared by dissolving 4.5 parts of N-methoxymethylated nylon (trade name: TORESIN EF-30T, Nagase ChemteX Corp.) and 1.5 parts of a copolymerized nylon resin (trade name: Amilan CM8000, Toray Industries Inc.) into a mixed solvent of methanol (65 parts) and n-butanol (30 parts). An undercoat layer having a film thickness of 0.85 μm was formed by dip-coating this undercoat layer coating liquid on the electrically conductive layer and drying the obtained coating film at 70° C. for 6 minutes.

Next, 10 parts of a crystalline hydroxygallium phthalocyanine crystal (charge generating material) having strong peaks at Bragg angles (2θ±0.2°) of 7.5°, 9.9°, 16.3°, 18.6°, 25.1°, and 28.3° in CuKα characteristic X-ray diffraction, 5 parts of polyvinyl butyral (trade name: S-LEC BX-1, Sekisui Plastics Co., Ltd.), and 250 parts of cyclohexanone were put into a sand mill using glass beads having a diameter of 0.8 mm, and were dispersed for a dispersion time of 3 hours. Then, 250 parts of ethyl acetate was added thereto, thereby preparing a charge generating layer coating liquid. A charge generating layer having a film thickness of 0.15 μm was formed by dip-coating this charge generating layer coating liquid on the undercoat layer and drying the obtained coating film at 100° C. for 10 minutes.

Next, 6.0 parts of an amine compound (charge transporting material) represented by the following Formula (CT-1), (CT-1)

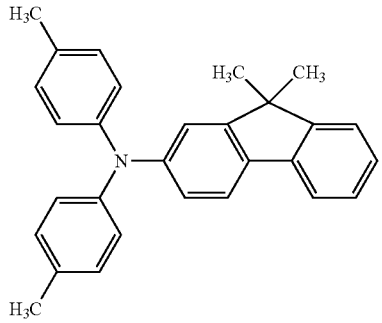

and 2.0 parts of an amine compound (charge transporting material) represented by the following Formula (CT-2), (CT-2)

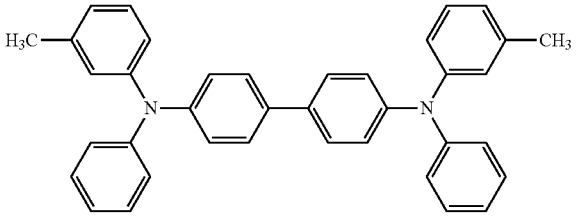

10 parts of bisphenol Z type polycarbonate (trade name: 2400, Mitsubishi Engineering-Plastics Corporation), and 0.36 parts of siloxane-modified polycarbonate (molar ratio of (B-1):(B-2)=95:5) having repeating structural units represented by the following Formulas (B-1) and (B-2) and having a terminal structure represented by the following Formula (B-3)

(B-1)

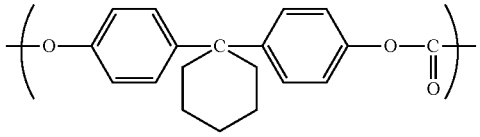

(B-2)

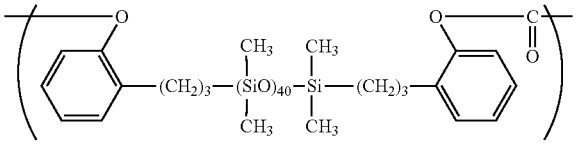

(B-3)

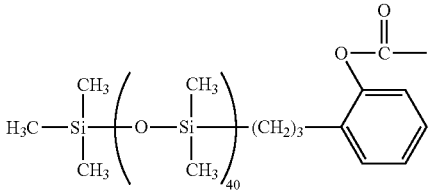

were dissolved in a mixed solvent of O-xylene (60 parts), dimethoxymethane (40 parts), and methyl benzoate (2.7 parts), thereby preparing a charge transporting layer coating liquid. A charge transporting layer having a film thickness of 16.0 μm was formed by dip-coating the charge transporting layer coating liquid on the charge generating layer and drying the obtained coating film at 125° C. for 30 minutes. An electrophotographic photosensitive member 1 including the charge transporting layer as a surface layer was manufactured as described above.

(Manufacturing Examples of Electrophotographic Photosensitive Members 2 to 38, X1 to X4, and C1 to C6)

Electrophotographic photosensitive members 2 to 38, X1 to X4, and C1 to C6 including a charge transporting layer as a surface layer were manufactured by the same operation as in Manufacturing Example of the electrophotographic photosensitive member 1 except for changing the electrically conductive layer coating liquid used to manufacture the electrophotographic photosensitive member, the film thickness of the electrically conductive layer, and presence or absence of the undercoat layer as illustrated in Table 4. Volume resistivity of the electrically conductive layer was measured in the same manner in the electrophotographic photosensitive member 1. The results are illustrated in Table 4.

The electrophotographic photosensitive members 1 to 38, X1, to X4 correspond to Examples of the present invention, and electrophotographic photosensitive members C1 to C6 correspond to Comparative Examples.

<Analysis of Electrically Conductive Layer of Electrophotographic Photosensitive Member>

Each of the electrophotographic photosensitive members 1 to 38, X1 to X4, and C1 to C6 for analyzing the electrically conductive layer was cut into 5 mm square pieces to obtain five pieces, the charge transporting layer and the charge generating layer of each of the pieces were delaminated using chlorobenzene, methyl ethyl ketone, and methanol, thereby exposing the electrically conductive layer. Five sample pieces for observation were prepared as described above per each of the electrophotographic photosensitive member.

First, an element ratio was analyzed by ESCA analysis using one sample piece per each of the electrophotographic photosensitive members in the same manner as described above.

Continuously, powder X-ray diffractometry was performed using one sample piece per each of the electrophotographic photosensitive members. Presence or absence of a peak at Bragg angles (2θ±0.1°) of 41.8 to 42.1° in CuKα characteristic X-ray diffraction was the same as in the case of measuring the particles.

Subsequently, three-dimensionalization (2 μm×2 μm×2 μm) of the electrically conductive layer was carried out using the remaining four pieces per each of the electrophotographic photosensitive members via a Slice & View procedure in focused ion beam scanning electron microscopy (FIB-SEM). The particles may be identified and a volume and a ratio of the particles in the electrically conductive layer may be determined from a contrast difference via the Slice & View procedure in the FIB-SEM. In the particles used in Comparative Examples, a volume and a ratio of the particles in the electrically conductive layer may also be determined in the same manner as described above. Slice & View conditions were as follows.

Analysis sample processing: FIB method
Processing and observing apparatus: NVision40 made by SII/Zeiss
Slice interval: 10 nm
Observation conditions
Acceleration voltage: 1.0 kV
Sample slope: 54°
WD: 5 mm
Detector: BSE detector
Aperture: 60 μm, high current
ABC: ON
Image resolution: 1.25 nm/pixel An analysis area was 2 μm (length)×2 μm (width), and information per cross section was accumulated, thereby obtaining a volume V per 2 μm (length)×2 μm (width)×2 μm (thickness) ($V_T$=8 $\mu m^3$). Further, measurement environment was as follows: temperature: 23° C., and pressure: $1\times10^{-4}$ Pa.

Further, Strata400S (sample slope: 52°) manufactured by FEI may also be used as the processing and observing apparatus. In addition, information on each cross section was obtained by performing image analysis on areas of the identified particles in the present invention or the particles used in the Comparative Examples. The image analysis was performed using an image processing software, Image-Pro Plus (Media Cybernetics). On the basis of the obtained information, the volume (V [$\mu m^3$]) of the particles in the present invention or particles used in the Comparative Example in a volume of 2 μm×2 μm×2 μm (unit volume: 8 $\mu m^3$) in each of the four sample pieces were calculated. Then, ((V[$\mu m^3$]/8 [$\mu m^3$])×100) was calculated. An average value of ((V[$\mu m^3$]/8 [$\mu m^3$])×100) values of four sample pieces was determined as a content (vol %) of the particles in the present invention or the particles used in Comparative Example in the electrically conductive layer based on an entire volume of the electrically conductive layer.

Further, in each of the four sample pieces, an average primary particle diameter of the particles according to one embodiment of the present invention or electro-conductive particles used in Comparative Examples was obtained. An average value of the average primary particle diameter of the particles in the present invention or the electro-conductive particles used in Comparative Example measured in four sample pieces was determined as an average primary particle diameter $D_1$ of the particles in the present invention or the particles used in Comparative Example in the electrically conductive layer. The results are illustrated in Table 4

TABLE 4

| Electro-photographic photosensitive member | Electrically Conductive layer coating liquid | X | Y | Presence or absence of X-ray diffraction peak | Average primary particle diameter ($D_1$) nm | Content in electrically conductive layer vol % | Film thickness of electrically conductive layer μm | Volume resistivity of electrically conductive layer Ω · cm | Presence or absence of undercoat layer |
|---|---|---|---|---|---|---|---|---|---|
| 1 | 1 | 1.16 | 0.78 | Presence | 60 | 40% | 20 | $2.5 \times 10^9$ | Presence |
| 2 | 2 | 2.50 | 1.72 | Presence | 60 | 40% | 20 | $6.0 \times 10^6$ | Presence |
| 3 | 3 | 3.40 | 1.90 | Presence | 60 | 50% | 20 | $1.3 \times 10^5$ | Presence |
| 4 | 4 | 4.00 | 1.96 | Presence | 60 | 50% | 20 | $8.0 \times 10^4$ | Presence |
| 5 | 5 | 1.50 | 0.94 | Presence | 60 | 40% | 20 | $2.5 \times 10^8$ | Presence |

TABLE 4-continued

| Electro-photographic photosensitive member | Electrically Conductive layer coating liquid | X | Y | Presence or absence of X-ray diffraction peak | Average primary particle diameter ($D_1$) nm | Content in electrically conductive layer vol % | Film thickness of electrically conductive layer μm | Volume resistivity of electrically conductive layer Ω · cm | Presence or absence of undercoat layer |
|---|---|---|---|---|---|---|---|---|---|
| 6 | 6 | 1.50 | 0.94 | Presence | 60 | 20% | 20 | $6.9 \times 10^9$ | Presence |
| 7 | 7 | 1.50 | 0.94 | Presence | 60 | 60% | 20 | $6.5 \times 10^7$ | Presence |
| 8 | 8 | 1.50 | 0.94 | Presence | 60 | 15% | 20 | $9.2 \times 10^9$ | Presence |
| 9 | 9 | 0.10 | 0.09 | Presence | 60 | 40% | 20 | $4.3 \times 10^{12}$ | Presence |
| 10 | 10 | 0.08 | 0.05 | Presence | 60 | 40% | 20 | $5.8 \times 10^{12}$ | Presence |
| 11 | 11 | 1.04 | 0.78 | Presence | 40 | 40% | 20 | $4.1 \times 10^9$ | Presence |
| 12 | 12 | 0.91 | 0.75 | Presence | 300 | 40% | 20 | $9.7 \times 10^9$ | Presence |
| 13 | 13 | 1.10 | 0.80 | Presence | 30 | 40% | 20 | $1.6 \times 10^9$ | Presence |
| 14 | 14 | 0.89 | 0.76 | Presence | 320 | 40% | 20 | $1.7 \times 10^9$ | Presence |
| 15 | 15 | 3.95 | 1.99 | Absence | 60 | 40% | 20 | $8.6 \times 10^4$ | Presence |
| 16 | 1 | 1.16 | 0.78 | Presence | 60 | 40% | 30 | $2.5 \times 10^9$ | Presence |
| 17 | 1 | 1.16 | 0.78 | Presence | 60 | 40% | 10 | $2.5 \times 10^9$ | Presence |
| 18 | 1 | 1.16 | 0.78 | Presence | 60 | 40% | 1 | $2.5 \times 10^9$ | Presence |
| 19 | 9 | 0.10 | 0.09 | Presence | 60 | 40% | 30 | $4.3 \times 10^{12}$ | Absence |
| 20 | 16 | 1.16 | 0.78 | Presence | 60 | 40% | 20 | $7.8 \times 10^9$ | Presence |
| 21 | 17 | 2.50 | 1.72 | Presence | 60 | 40% | 20 | $7.2 \times 10^5$ | Presence |
| 22 | 18 | 3.40 | 1.90 | Presence | 60 | 50% | 20 | $1.4 \times 10^5$ | Presence |
| 23 | 19 | 4.00 | 1.96 | Presence | 60 | 50% | 20 | $9.0 \times 10^4$ | Presence |
| 24 | 20 | 1.50 | 0.94 | Presence | 60 | 40% | 20 | $6.1 \times 10^8$ | Presence |
| 25 | 21 | 1.50 | 0.94 | Presence | 60 | 20% | 20 | $1.3 \times 10^{10}$ | Presence |
| 26 | 22 | 1.50 | 0.94 | Presence | 60 | 60% | 20 | $1.2 \times 10^8$ | Presence |
| 27 | 23 | 1.50 | 0.94 | Presence | 60 | 15% | 20 | $1.7 \times 10^{10}$ | Presence |
| 28 | 24 | 0.10 | 0.09 | Presence | 60 | 40% | 20 | $1.3 \times 10^{13}$ | Presence |
| 29 | 25 | 0.08 | 0.05 | Presence | 60 | 40% | 20 | $1.8 \times 10^{13}$ | Presence |
| 30 | 26 | 1.04 | 0.78 | Presence | 40 | 40% | 20 | $8.3 \times 10^9$ | Presence |
| 31 | 27 | 0.91 | 0.75 | Presence | 300 | 40% | 20 | $1.9 \times 10^{10}$ | Presence |
| 32 | 28 | 1.10 | 0.80 | Presence | 30 | 40% | 20 | $3.3 \times 10^9$ | Presence |
| 33 | 29 | 0.89 | 0.76 | Presence | 320 | 40% | 20 | $3.6 \times 10^9$ | Presence |
| 34 | 30 | 3.95 | 1.99 | Absence | 60 | 40% | 20 | $2.3 \times 10^5$ | Presence |
| 35 | 16 | 1.16 | 0.78 | Presence | 60 | 40% | 30 | $7.8 \times 10^9$ | Presence |
| 36 | 16 | 1.16 | 0.78 | Presence | 60 | 40% | 10 | $7.8 \times 10^9$ | Presence |
| 37 | 16 | 1.16 | 0.78 | Presence | 60 | 40% | 1 | $7.8 \times 10^9$ | Presence |
| 38 | 24 | 0.10 | 0.09 | Presence | 60 | 40% | 30 | $1.3 \times 10^{13}$ | Absence |
| X1 | X1 | 0.82 | 0.75 | Presence | 60 | 35% | 30 | $1.4 \times 10^{10}$ | Absence |
| X2 | X1 | 0.82 | 0.75 | Presence | 60 | 35% | 15 | $1.4 \times 10^{10}$ | Absence |
| X3 | X2 | 0.82 | 0.75 | Presence | 60 | 39% | 30 | $2.6 \times 10^{10}$ | Absence |
| X4 | X2 | 0.82 | 0.75 | Presence | 60 | 39% | 15 | $2.6 \times 10^{10}$ | Absence |
| C1 | C1 | 0.00 | 0.00 | Absence | 60 | 40% | 20 | $>1.0 \times 10^{13}$ | Presence |
| C2 | C2 | 4.13 | 1.98 | Absence | 60 | 40% | 20 | $6.5 \times 10^3$ | Presence |
| C3 | C3 | — | — | Absence | 210 | 40% | 20 | $>1.0 \times 10^{13}$ | Presence |
| C4 | C4 | — | — | Absence | 100 | 40% | 20 | $4.5 \times 10^5$ | Presence |
| C5 | C5 | — | — | Absence | 150 | 30% | 20 | $2.0 \times 10^9$ | Presence |
| C6 | C1 | 0.00 | 0.00 | Absence | 60 | 40% | 30 | $>1.0 \times 10^{13}$ | Absence |

[Evaluation]

(Paper-Passing Durability Test of Electrophotographic Photosensitive Member)

Each of the electrophotographic photosensitive members 1 to 38, X1 to X4, and C1 to C6 for a paper-passing durability test was mounted in a laser beam printer (trade name: LBP7200C, Canon Inc.), and the paper-passing durability test was performed in an environment of low-temperature and low humidity (15° C./10% RH). In the paper-passing durability test, image output on 25000 sheets was carried out by performing a printing operation in an intermittent mode in which character images were output on letter paper one by one with a printing rate of 2%. In addition, when the paper-passing durability test was started and image output on 15000 sheets and 25000 sheets were terminated, a sample image (a halftone image of a one-dot keima (knight of Japanese chess) pattern) for evaluating images was output on one sheet, respectively. Image evaluation criteria were as follows. The results are illustrated in Table 5.

A: Leakage did not occur at all.

B: Leakage was slightly observed as a small black spot.

C: Leakage was certainly observed as a large black spot.

D: Leakage was observed as a black spot and a short horizontal black stripe.

E: Leakage was observed as a long horizontal black stripe.

(Evaluation of Definition of Print Image of Electrophotographic Photosensitive Member)

Reproducibility of isolated dots was evaluated by measuring image concentrations in an environment of room temperature and normal humidity (23° C./50% RH) using the electrophotographic photosensitive members 1 to 38, X1 to X4, and C1 to C6 as described below.

A modified version of a laser beam printer (trade name: Color LaseJet Enterprise M552, Hewlett-Packard Co., Ltd.) was used as an electrophotographic apparatus for evaluation. As modification points, charging conditions and a laser exposure amount were set to be variable. Further, each of the manufactured electrophotographic photosensitive members was mounted in a process cartridge for a black color and attached to a station of the process cartridge for a black color. Further, the laser beam printer was set to work even though process cartridges for other colors (cyan, magenta, and yellow colors) were not mounted in a main body of the laser beam printer.

A potential probe (trade name: model 6000B-8, TREK Japan Co., Ltd.) attached to a development position of the process cartridge was used to measure a surface potential of the electrophotographic photosensitive member, and an electric potential of a central portion of the electrophotographic photosensitive member in a length direction was measured using a surface potential meter (trade name: model 344, TREK Japan Co., Ltd.).

At the time of outputting the image, only the process cartridge for a black color was attached to the main body of the laser beam printer, such that monochromatic image formed only with a black toner was output.

Figure 8:
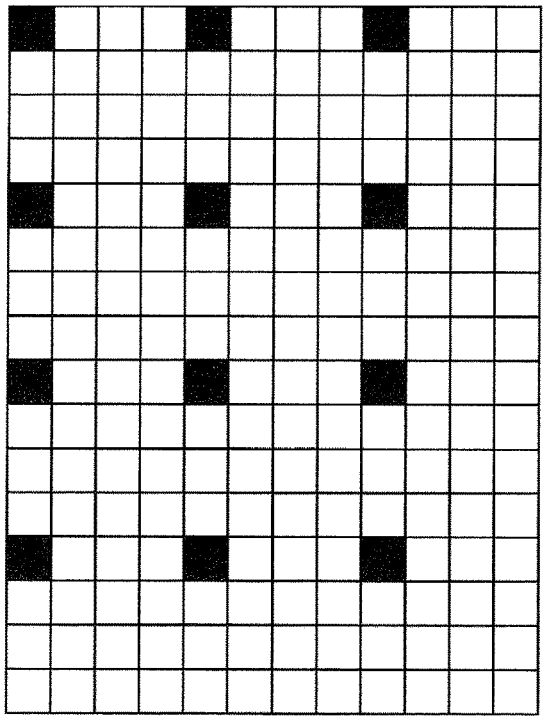
FIG. 8 is an image pattern used for image evaluation.

After a charging potential Vd of the apparatus was set to −600V, an exposure potential V1 was set to −200V, and a development potential Vcdc was set to −400V, an image obtained by outputting an image pattern (FIG. 8), which was exposed with a 3-dot interval per one dot, was used as an evaluation image.

At the time of measuring a concentration, 'REFLECTMETER MODEL TC-6DS' (Tokyo denshoku Co. Ltd.) was used, and a concentration [%] was calculated from a difference between whiteness of a white portion of a printout image and whiteness of dot patch which were measured. As a filter, amber filter was used. In the present invention, a case in which a concentration of the printout image was 8.0% or more was used as a criterion in which the exposed isolated dots were clearly reproduced.

The results are illustrated in Table 5.

TABLE 5

| | Leakage test | | | |
|---|---|---|---|---|
| | At the time of starting paper-passing durability test | After termination of image output on 15000 sheets | After termination of image output on 25000 sheets | Image concentration of isolated dot % |
| Example | | | | |
| 1 | A | A | A | 10.8 |
| 2 | A | A | B | 12.2 |
| 3 | A | B | B | 12.4 |
| 4 | A | B | C | 12.5 |
| 5 | A | A | A | 11.5 |
| 6 | A | A | A | 9.8 |
| 7 | A | B | B | 10.3 |
| 8 | A | A | A | 8.3 |
| 9 | A | A | A | 9.1 |
| 10 | A | A | A | 8.2 |
| 11 | A | A | B | 10.7 |
| 12 | A | A | B | 10.3 |
| 13 | A | B | B | 10.8 |
| 14 | A | B | B | 10.5 |
| 15 | A | B | C | 11.2 |
| 16 | A | A | A | 11.2 |
| 17 | A | A | A | 10.5 |
| 18 | A | A | B | 10.2 |
| 19 | A | B | B | 9.4 |
| 20 | A | A | A | 10.7 |
| 21 | A | A | B | 11.7 |
| 22 | A | B | B | 12.3 |
| 23 | A | B | C | 12.6 |
| 24 | A | A | A | 11.4 |
| 25 | A | A | A | 9.6 |
| 26 | A | B | B | 10.1 |
| 27 | A | A | A | 8.1 |
| 28 | A | A | A | 9.0 |
| 29 | A | A | A | 8.0 |
| 30 | A | A | B | 10.8 |
| 31 | A | A | B | 10.2 |
| 32 | A | B | B | 10.7 |
| 33 | A | B | B | 10.4 |
| 34 | A | B | C | 11.3 |
| 35 | A | A | A | 11.1 |
| 36 | A | A | A | 10.4 |
| 37 | A | A | B | 10.1 |
| 38 | A | B | B | 9.2 |
| X1 | A | B | B | 9.7 |
| X2 | A | B | B | 9.4 |
| X3 | A | B | B | 10.3 |
| X4 | A | B | B | 10.1 |
| Comparative Example | | | | |
| C1 | A | A | A | 4.3 |
| C2 | C | C | D | 12.4 |
| C3 | A | A | A | 4.1 |
| C4 | C | C | D | 12.4 |
| C5 | B | C | C | 5.2 |
| C6 | A | A | B | 5.6 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-037024, filed Feb. 28, 2017, which is hereby incorporated by reference herein in its entirety.

What is claimed is:

1. An electrophotographic photosensitive member comprising a support, an electrically conductive layer, and a photosensitive layer in this order, wherein the electrically conductive layer contains a binder material and particles represented by General Formula (1)

$$Nb_{2.00}O_{5.00-X}N_Y \quad (1)$$

wherein, in Formula (1), Nb is a niobium atom, O is an oxygen atom, N is a nitrogen atom, and $0.00<Y<X$ 4.00.

2. The electrophotographic photosensitive member according to claim 1, wherein the particles have a peak at a Bragg angle (2θ±0.1°) of 41.8 to 42.1° in CuKα characteristic X-ray diffraction.

3. The electrophotographic photosensitive member according to claim 1, wherein in General Formula (1), $0.10\leq Y<X\leq 1.50$.

4. The electrophotographic photosensitive member according to claim 1, wherein the particles have an average primary particle diameter of 40 nm or more to 300 nm or less.

5. The electrophotographic photosensitive member according to claim 1, wherein volume resistivity of the electrically conductive layer is $1.0\times10^5$ Ω·cm or more to $5.0\times10^{12}$ Ω·cm or less.

6. The electrophotographic photosensitive member according to claim 1, wherein a content of the particles is 20 vol % or more to 50 vol % or less based on a total volume of the electrically conductive layer.

7. The electrophotographic photosensitive member according to claim 1, wherein powder resistivity of the particles is $2.0\times10^1$ Ω·cm or more.

8. A process cartridge integrally supporting an electrophotographic photosensitive member and at least one unit selected from the group consisting of a charging unit, a developing unit, a transferring unit and a cleaning unit, and being attachable to and detachable from a main body of an electrophotographic apparatus, wherein the electrophotographic photosensitive member comprises a support, an electrically conductive layer, and a photosensitive layer in this order, wherein the electrically conductive layer contains a binder material and particles represented by General Formula (1)

$$Nb_{2.00}O_{5.00-X}N_Y \quad (1)$$

wherein, in Formula (1), Nb is a niobium atom, O is an oxygen atom, N is a nitrogen atom, and 0.00<Y<X 4.00.

9. An electrophotographic apparatus comprising an electrophotographic photosensitive member, a charging unit, an exposing unit, a developing unit and a transferring unit, wherein the electrophotographic photosensitive member comprises a support, an electrically conductive layer, and a photosensitive layer in this order, wherein the electrically conductive layer contains a binder material and particles represented by General Formula (1)

$$Nb_{2.00}O_{5.00-X}N_Y \quad (1)$$

wherein, in Formula (1), Nb is a niobium atom, O is an oxygen atom, N is a nitrogen atom, and 0.00<Y<X 4.00.

* * * * *